US010144892B2

(12) United States Patent
Kosler et al.

(10) Patent No.: US 10,144,892 B2
(45) Date of Patent: Dec. 4, 2018

(54) SYSTEM AND METHOD FOR DEWATERING COAL COMBUSTION RESIDUALS

(71) Applicant: AECOM Technical Services, Inc., Austin, TX (US)

(72) Inventors: Steven Kosler, Austin, TX (US); David Seeger, Austin, TX (US); George Richard Bird, Wildwood, MO (US)

(73) Assignee: AECOM Technical Services, Inc., Austin, TX (US)

( * ) Notice: Subject to any disclaimer, the term of this patent is extended or adjusted under 35 U.S.C. 154(b) by 0 days.

(21) Appl. No.: 15/652,740

(22) Filed: Jul. 18, 2017

(65) Prior Publication Data

US 2018/0030362 A1 Feb. 1, 2018

Related U.S. Application Data

(60) Provisional application No. 62/368,029, filed on Jul. 28, 2016.

(51) Int. Cl.

| | |
|---|---|
| ***F26B 5/12*** | (2006.01) |
| ***C10L 5/04*** | (2006.01) |
| ***E02D 3/10*** | (2006.01) |

(52) U.S. Cl.

CPC ..... *C10L 5/04* (2013.01); *E02D 3/103* (2013.01); *F26B 5/12* (2013.01); *C10L 2290/08* (2013.01)

(58) Field of Classification Search

CPC ..... F26B 5/12; C10L 5/04; C10L 2290/08; E02D 3/103

USPC ..... 34/398

See application file for complete search history.

(56) References Cited

U.S. PATENT DOCUMENTS

| | | | | |
|---|---|---|---|---|
| 4,606,704 A | | 8/1986 | Sloan | |
| 5,724,751 A | * | 3/1998 | Ellingsen | B01D 1/18 34/147 |
| 6,105,273 A | * | 8/2000 | Johanson | B01J 8/08 34/267 |
| 6,233,841 B1 | * | 5/2001 | Beach | A23L 3/54 34/203 |
| 7,694,432 B2 | * | 4/2010 | Eriksson | F26B 3/283 110/245 |

(Continued)

FOREIGN PATENT DOCUMENTS

| | | | | |
|---|---|---|---|---|
| CA | 2803734 A1 | * | 12/2011 | B09C 1/005 |
| EP | 2585234 B1 | * | 3/2014 | B09C 1/005 |

(Continued)

OTHER PUBLICATIONS

Geotextile internet search on Apr. 10, 2018.*

*Primary Examiner* — Stephen M Gravini

(74) *Attorney, Agent, or Firm* — DuBois, Bryant & Campbell, LLP; William D. Wiese

(57) ABSTRACT

The installation of prefabricated drains in a horizontal, generally co-planar pattern below the surface of the CCR with suction or a vacuum to withdraw water from the CCR material to lower the water level down to the level of the prefabricated drains below the CCR surface. Dewatering may be coupled with imparting vibrations to the material to further promote both additional dewatering and compaction of the CCR material in the pond. A suitably graded bottom ash, fly ash, sand or large-diameter-solid particle layer may be added on top of the horizontal drains to enhance dewatering of finer CCR material.

16 Claims, 6 Drawing Sheets

(56) References Cited

U.S. PATENT DOCUMENTS

| | | | | |
|---|---|---|---|---|
| 8,726,533 | B2 * | 5/2014 | Cai | F26B 21/02 110/233 |
| 8,801,904 | B2 * | 8/2014 | Miller | C10B 7/00 198/813 |
| 8,806,771 | B2 * | 8/2014 | Holmes | B29B 13/065 219/388 |
| 9,341,410 | B1 * | 5/2016 | Griffin | F26B 17/00 |
| 9,556,579 | B2 * | 1/2017 | Ahlberg | E02D 3/00 |
| 9,732,492 | B2 * | 8/2017 | Ahlberg | E02D 3/00 |
| 9,790,703 | B1 * | 10/2017 | Hector, Jr. | E04H 9/04 |
| 2002/0113014 | A1 * | 8/2002 | Stroup | B01D 29/01 210/637 |
| 2010/0200516 | A1 | 8/2010 | Hwang | |
| 2013/0101353 | A1 * | 4/2013 | Bousquet | B09C 1/005 405/128.3 |
| 2017/0259310 | A1 * | 9/2017 | Froh | B09B 1/004 |
| 2018/0030362 | A1 * | 2/2018 | Kosler | C10L 5/04 |

FOREIGN PATENT DOCUMENTS

| | | | | |
|---|---|---|---|---|
| FR | 2961723 | A1 * | 12/2011 | B09C 1/005 |
| FR | 2961723 | B1 * | 8/2012 | B09C 1/005 |
| JP | 6029582 | B2 * | 11/2016 | B09C 1/005 |
| WO | WO 2011161366 | A1 * | 12/2011 | B09C 1/005 |

* cited by examiner

SYSTEM AND METHOD FOR DEWATERING COAL COMBUSTION RESIDUALS

PRIORITY STATEMENT UNDER 35 U.S.C. § 119 & 37 C.F.R. § 1.78

This non-provisional application claims priority based upon prior U.S. patent application Ser. No. 62/368,029 filed Jul. 28, 2016, in the names of Steven Kosler, David Seeger, and G. Richard Bird entitled "SYSTEM AND METHOD FOR DEWATERING COAL COMBUSTION RESIDUALS", the disclosures of which are incorporated herein in their entirety by reference as if fully set forth herein.

FIELD OF INVENTION

This invention relates to closure of coal combustion residuals (CCR), sometimes referred to as coal combustion products (CCP), fly ash, gypsum, calcium sulfite, bottom ash, pyrites, ponds or impoundments and more specifically, a method and apparatus for dewatering and consolidating CCR to reduce its volume, water content, and/or to stabilize its physical properties for disposal, closure or reuse.

BACKGROUND OF THE INVENTION

Past coal-fired generation activities have resulted in CCR sediments in disposal ponds or impoundments. These CCR ponds require closure to mitigate their impact on the neighboring environment and human or animal health. Closure is also now required by U.S. environmental regulation. However, to facilitate closure, the CCR ponds are sometimes dewatered by pre-drainage of the CCR to enhance strength and stability of the material and thereby provide a stable surface on which to operate earthmoving and grading equipment. If pre-drainage (e.g., by pumping wellpoints installed in the CCR to lower the groundwater table) does not sufficiently improve strength and stability of the in-place CCR due to its drainage properties, it becomes necessary to improve CCR strength and stability with admixtures such as quicklime, dry fly ash, or Portland cement; evaporative drying in place, or by dredging or excavating the CCR, dewatering it to consolidate it and improve its strength and handling characteristics, and landfilling it either in the same place or by hauling it a different disposal location.

CCR is known to be unstable when saturated. When saturated CCR is subject to shear strain, it densifies and expels water, resulting in a near total loss of shear strength. In this state, the material becomes a viscous fluid and may begin to slide or flow. This process may result in overtopping of impoundments and makes excavation and handling difficult to impossible. Reducing the water content of the CCR material by only a few percentage points has a dramatic effect on its behavior, allowing stable, near vertical cuts suitable for mass excavation.

Dewatering methods include both mechanical dewatering and geotube dewatering. In mechanical dewatering, dredged CCR is pumped to a mechanical dewatering unit (e.g., a centrifuge, a belt press, or a filter press), dewatered, and the filtered CCR (filter cake) is placed in a landfill. Often, the filtered CCR cake requires solidification/stabilization because it cannot support earthwork equipment that is used on the surface of landfills.

Geotube dewatering uses geotubes for dewatering. Geotubes are large filter bags made of geotextile. Dredged CCR is pumped into a geotube and the water is allowed to drain, leaving CCR solids in the geotube. After the geotube is filled with dredged CCR, it is allowed to drain for some time. When the geotube collapses as water is drained, more dredged CCR is pumped into the geotube. After cycles of filling and draining, the geotube is filled with "drained" CCR. The drained CCR may be dewatered further, if desired, by evaporative drying for several weeks. The dewatered CCR may be taken off site for disposal or disposed of in an on-site landfill.

Consolidation refers to a process of subjecting the CCR to a load so that the CCR undergoes volume reduction and strength gain as a result of water being effectively forced out of the loaded CCR volume. Since CCR does not allow water to flow out easily due to its very low hydraulic conductivity, drainage pathways are provided in the CCR volume to accelerate consolidation. The most common way of providing drainage pathways is to insert prefabricated drains vertically into the CCR. The prefabricated drains consist of a plastic core wrapped with geotextile filter which, when installed in the CCR, facilitates the flow of water into the drain and to the surface of the ground. Prefabricated drains can consist of flat plastic cores with a geotextile envelope, commonly installed using a hollow rectangular mandrel that is pressed into the ground, or perforated circular plastic pipe/tube surrounded by a geotextile envelope, installed by drilling an open hole with drilling fluid, or jetting or driving an open-ended temporary steel casing/tube or advancing a continuous hollow auger and inserting the perforated plastic pipe or tube and geotextile envelope before the temporary casing/tube or hollow auger is extracted.

SUMMARY OF THE INVENTION

A method and system for dewatering and consolidating coal combustion residuals (CCR) (or coal combustion products (CCP)) such as fly ash, bottom ash, pyrites, flue gas desulfurization sludge, etc., that uses horizontal drains installed in a CCR pond before, during or after the CCR is added to the pond. The horizontal drains may be installed below the surface of the CCR or on the surface of existing CCR to which additional CCR material is added. The drains may be connected to a vacuum pump via collector hoses or pipe, and a collection header pipe. The vacuum pump operation facilitates the removal of water from the CCR, consolidates the settled material and reduces its volume, enabling continued discharge of dredged CCR or disposal of the material by removal and landfilling or capping (i.e., closing the material in place).

In some embodiments, imparting vibrational energy to the surface layers of the CCR will improve compaction of the CCR to provide additional strength to the CCR for supporting earth working equipment that may be required to be driven on the surface of the pond for the purpose of closing it. Vibrational energy may be supplied by transporting or hauling compaction equipment or driving vehicle-based equipment across the surface. Successive installation of horizontal drains within accumulating CCR and consolidation by vacuum pumping may continue until the disposal pond is filled with consolidated CCR. In the case of closing the pond in place, vacuum pumping may be continued for some period after final cover installation to enhance containment performance by over-consolidation. The horizontal drain system may also be used to deliver liquid reagents for sediment treatment or to circulate water for flushing. The method enables the disposal pond to be on land or under water below the original sediment line.

Additionally in some embodiments, the prefabricated drains may be laid out on a surface of ground or other CCR and a suitably graded 3-inch to 4-foot thick layer of bottom ash, fly ash, sand or larger-diameter-solid particles may be added on top of the horizontal prefabricated drains. This can be achieved via mechanical placement or dredging the material from a nearby pond over the drains. Large diameter solid particles will inherently settle atop the drains as the material is placed over the drains as the large particles are more mobile in gravity settling. In this manner, finer CCR may be more efficiently dewatered using the above described method of vacuum consolidation dewatering. This layer of ash or sand over the prefabricated drains filters the water and allows it to flow through without carrying the very fine particles of CCR to the surface of the prefabricated drains themselves. The finer particles may have a tendency to plug off the prefabricated drain geotextile covering, oftentimes referred to as the filter jacket, and the layer of suitably graded ash or sand prevents that from happening.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention is directed to improved methods and systems for, among other things, system and method for dewatering coal combustion residuals. The configuration and use of the presently preferred embodiments are discussed in detail below. It should be appreciated, however, that the present invention provides many applicable inventive concepts that can be embodied in a wide variety of contexts other than system and method for dewatering coal combustion residuals. Accordingly, the specific embodiments discussed are merely illustrative of specific ways to make and use the invention, and do not limit the scope of the invention.

Embodiments of the present invention include the installation of prefabricated drains in a horizontal, generally co-planar pattern below the surface of the CCR and putting suction or a vacuum on the horizontal drains to withdraw water from the CCR material to lower the water level down to the level of the prefabricated drains below the CCR surface. In some embodiments, this dewatering may be coupled with imparting vibrations to the material to further promote both additional dewatering and compaction of the CCR material in the pond. In addition, a suitably graded bottom ash, fly ash, sand or large-diameter-solid particle layer may be added on top of the horizontal drains to enhance dewatering of finer CCR material.

Various embodiments include the dewatering of CCR ponds with a process comprising a combination of one or more of (1) installing the prefabricated drains beneath the surface of the existing CCR pond to dewater and vacuum consolidate the entire pond or installing the drains in a sectioned-off, dewatering area within an existing CCR pond; (2) installing prefabricated drains under free water on top of CCR or beneath the surface of the CCR to a depth in the range of 0 to 20 ft. below the surface of the CCR; (3) installing prefabricated drains under CCR or under CCR and free water through: (a) horizontal drilling, (b) knifing with mechanical equipment, (c) knifing with water jets, or (d) trenching; (4) adding a layer of 3-inch to 4-foot thickness of suitably graded bottom ash, fly ash, sand or suitable large-diameter-solid particles to aid in the dewatering of finer CCR material; and (5) imparting vibrational energy (mechanical vibration) to material to compact the CCR and re-liquefy the material to enhance dewatering of CCR, and, in some embodiments, performing mechanical vibration and vacuum dewatering in cycles or continuous vacuum dewatering and imparting vibration to the CCR pond in cycles. For example, low ground pressure equipment may be driven over the top of the CCR to impart vibration while the vacuum dewatering is operating continuously or intermittently after vibration activities are complete.

Figure 1:
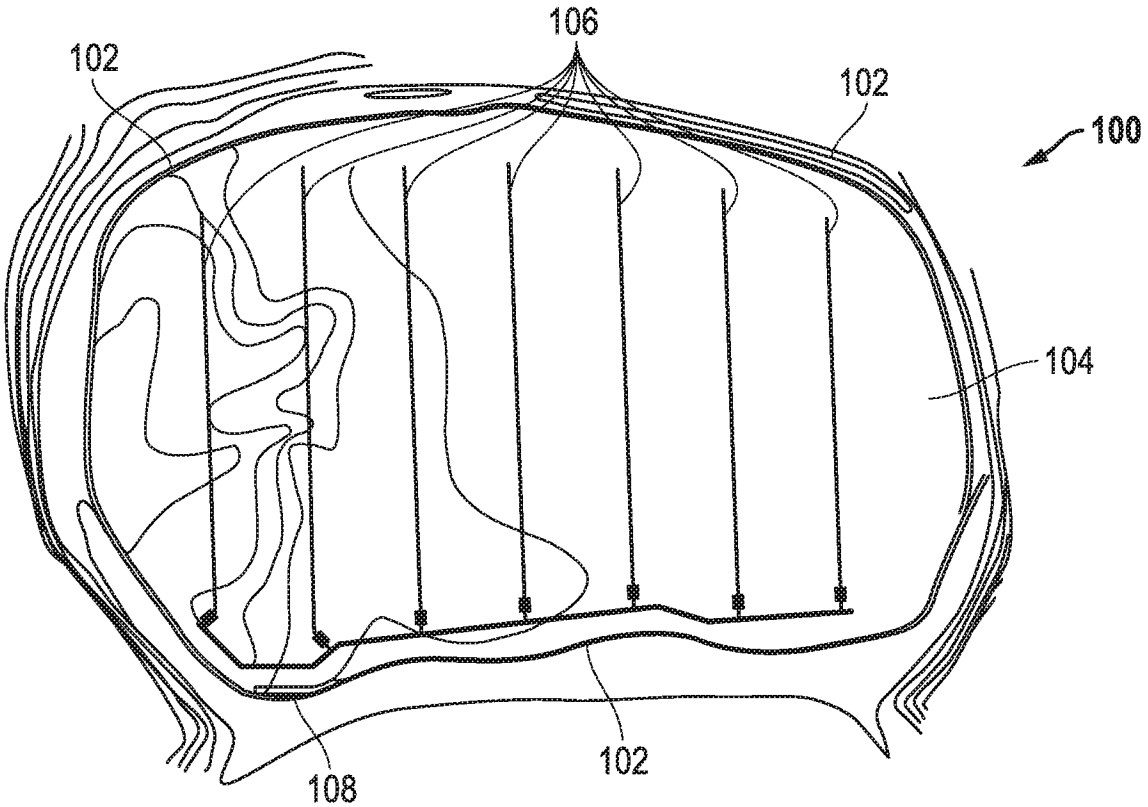
FIG. 1 is a topological view of a CCR pond having one embodiment of the horizontal drains of the present invention.

Referring now to FIG. 1 which shows a topological view of a CCR pond 100 having a retaining berm or dike 102 and to hold the CCR 104. CCR sediment is discharged to the CCR pond 100. Solids in the CCR 104 settle out at the bottom and the thickness of the settlement at the bottom of the CCR pond 100 gradually increases over time. A plurality of co-planar drains 106 are installed in the CCR pond 100. The number of horizontal drains may vary depending on the specific circumstances the hydraulic conductivity of settled sediment. At least one vacuum pump 108 is hydraulically connected to the plurality of co-planar drains 106.

In some embodiments, the plurality of co-planar drains are installed beneath the surface of the CCR 104 and in other embodiments, the plurality of co-planar drains 106 are place on top of the surface of the CCR 104 and CCR 104 from other locations in the CCR pond 100 is subsequently dredged or processed to cover the plurality of co-planar drains 106. The plurality of co-planar drains 106 may be wick drains used for consolidation of soft clay soils or perforated, flexible tube drains wrapped with geotextile.

The plurality of co-planar drains 106 are hydraulically connected to a vacuum pump 108. The operation of vacuum pump 108 exerts suction to and through the plurality of co-planar drains 106. This vacuum suction extracts water from the CCR 104 surrounding plurality of co-planar drains 106, leading to consolidation of the CCR 104. As water is removed from the CCR 104, the thickness of settled sediment in the CCR 104 decreases and more capacity is created in the CCR pond 100.

Figure 2:
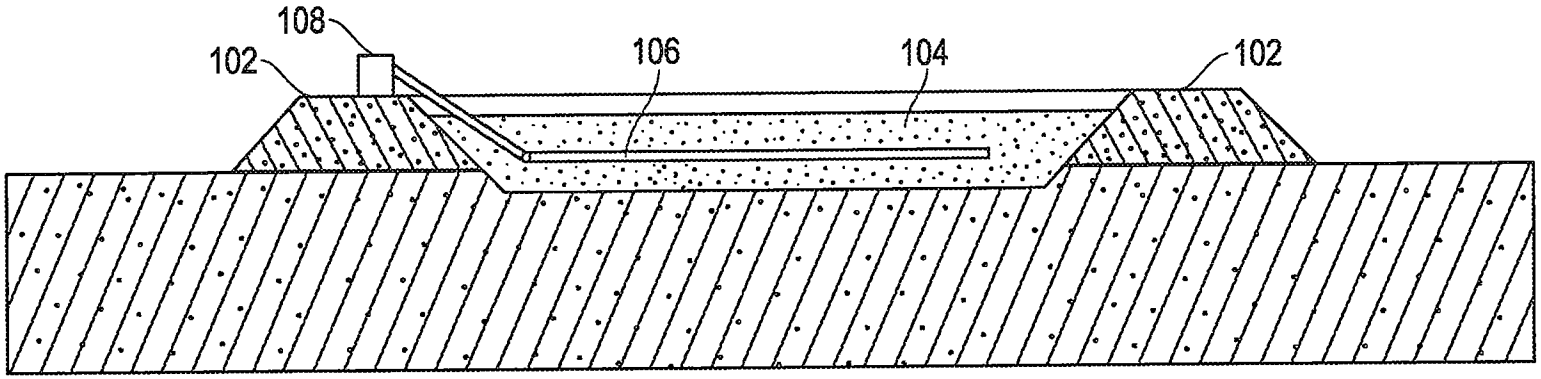
FIG. 2 is a profile of a typical CCR pond having one embodiment of the horizontal drains of the present invention shown from the side view.
Figure 3:
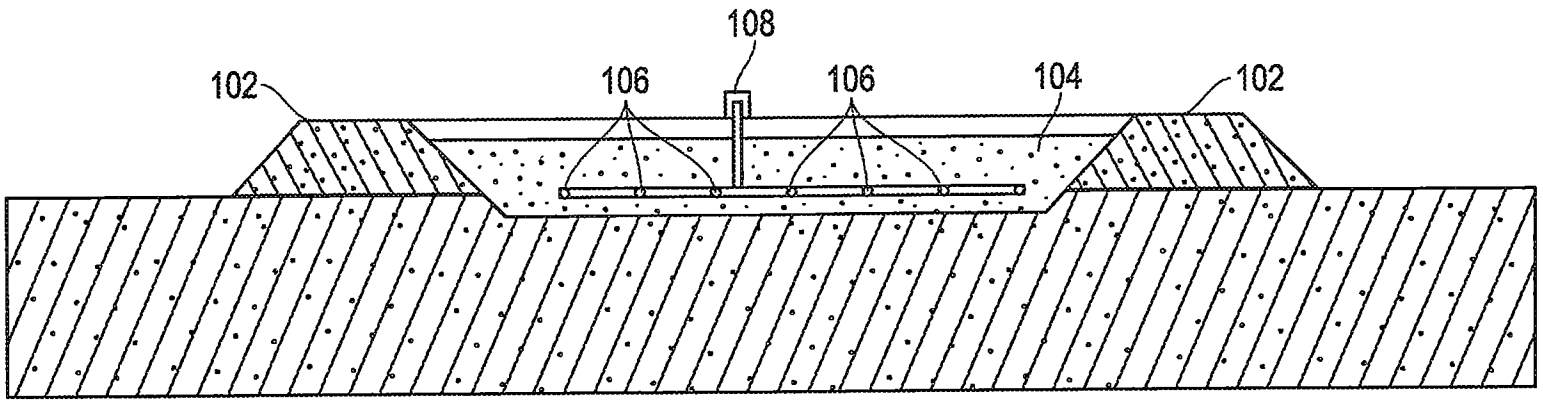
FIG. 3 is a profile of a typical CCR pond having one embodiment of the horizontal drains of the present invention shown from the end view.

FIG. 2 shows a profile of a typical CCR pond 100 having one embodiment of the plurality of co-planar drains 106 of the present invention shown from the side view, and FIG. 3 is a profile of a typical CCR pond having one embodiment of the horizontal drains of the present invention shown from the end view.

In a test case, CCR material was acquired from a CCR pond primarily composed of fly ash. The CCR material was placed in a sample container having a horizontal prefabricated drain installed at the bottom of the unit. The CCR was re-mixed or re-slurried in the sample container as received in the lab. The re-mixed CCR sample had a starting weight percent solids of 63.3% where the calculation was:

(weight of dry solid/total weight of starting slurry sample)*100=weight percent solids The starting CCR material that was added to the sample container was slurry that flowed easily. The re-mixed slurry sample was poured into the sample container and the horizontal prefabricated drain was attached to a vacuum pump that was used to draw out the water from the CCR material. After some time, the water being drawn out of the unit slowed to drops and then stopped. At that point, vibrational energy was imparted to the container by vibrating the sides of the container. The vibrational energy caused the seemingly somewhat dry solids to re-liquefy or re-slurry. Additional water could then be vacuumed from the unit. At the end of the test when the CCR had been dewatered the CCR solids were at 82-83 weight percent solids. These solids are suitable for excavating and disposal or additional pond closure activities.

In a second demonstration of vacuum dewatering and consolidation using horizontal drains, a field demonstration was undertaken in a test area that was constructed on location in a coal ash pond at a coal-fired power plant. The horizontal test area covered approximately 20-30% of the entire larger test area that was separated from the overall pond. There were two test areas, so two different types of drains could be tested in separate areas that were each approximately 20 ft. wide and 200-300 ft. long where the horizontal drains were laid out on the same elevation, i.e., co-planar. Once laid down, CCR (fly ash in this case) was dredged and filled into the test area to a depth of approximately 5 ft. over the horizontal drains. After filling the test area, a pump was used to successfully pump well in excess of 3000 gallons of water out of the horizontal drains across 3 days. On the third day, vibrational energy was imparted to the CCR surface by driving a heavy amphibious hydraulic excavator back and forth across the surface of the CCR pond both over the drains and in areas of the pond not over the drains. The surface over the drains was stronger than the surface not over the drain as described in the following results.

Vane shear data were recorded and indicated general higher results for locations over the horizontal drains as compared to those locations not located over the drains. The average of results for over the drains was 651 PSF (pounds per square foot) and for the locations not over the drains was 480 PSF. The average results are shown in the table below.

| Vane Shear Measurement Location | Average (PSF) | Range (PSF) | No. of Vane Shear Measurement Locations | No. of Average Vane Shear below 500 PSF |
|---|---|---|---|---|
| Over the drains | 651 | 353-1016 | 13 | 2 |
| Outside of drain installation area | 480 | 435-566 | 3 | 2 |

Only two of the thirteen averages for each vane shear location made over the horizontal drains were below 500 PSF, compared with 2 of the 3 averages for each vane shear location made not over a horizontal drain. The vane shear results indicate that the fly ash over the drains has significantly higher strength (+36%) than the fly ash not over the drain area. The average vane shear strengths measured in the drain areas were consistently in the 500 to 700 PSF range. Based on this result, we conclude that repeated compaction and horizontal drain operation would further increase the vane shear strength of the fly ash.

Holes were dug by an excavator at the CCR pond site approximately two weeks after the demonstration test was completed. A long-reach excavator was used to dig large holes in the ash at locations above the drains and at locations not above the horizontal drains to determine if any differences in the samples could be observed. Primarily the intention was to investigate the thickness of the top dry "crust" of the fly ash, the ash stability, and wetness. In general the ash over the horizontal drains was dry and stable down to four to five feet below the surface and the ash not over the drains was not as dry nor as stable, and the crust at those locations was only one-half to two feet thick.

Figure 4:
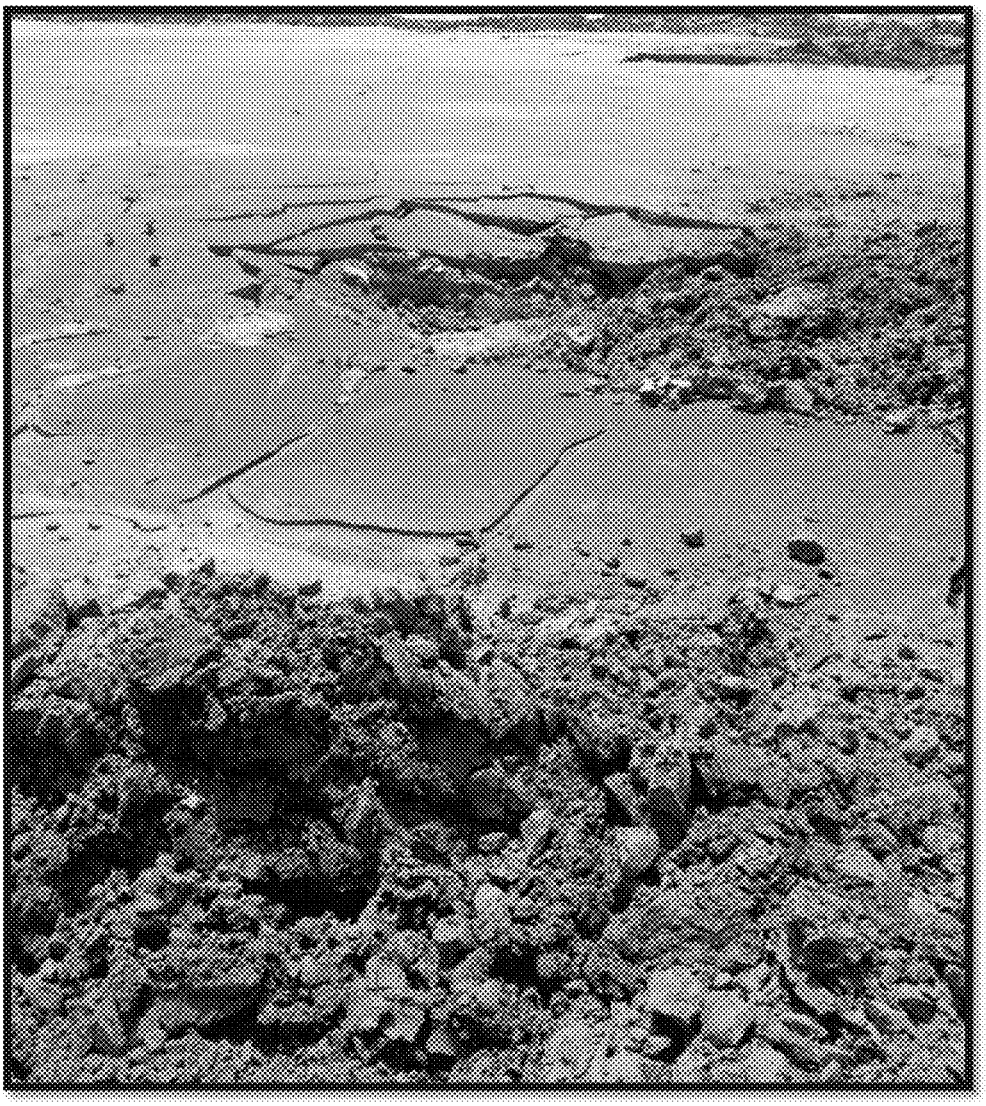
FIG. 4 is a photograph of a hole dug at a point in a dewatered CCR pond approximately 15 feet away from the horizontal drain in which the crust is one to two feet thick and the CCR is wet underneath.
Figure 5:
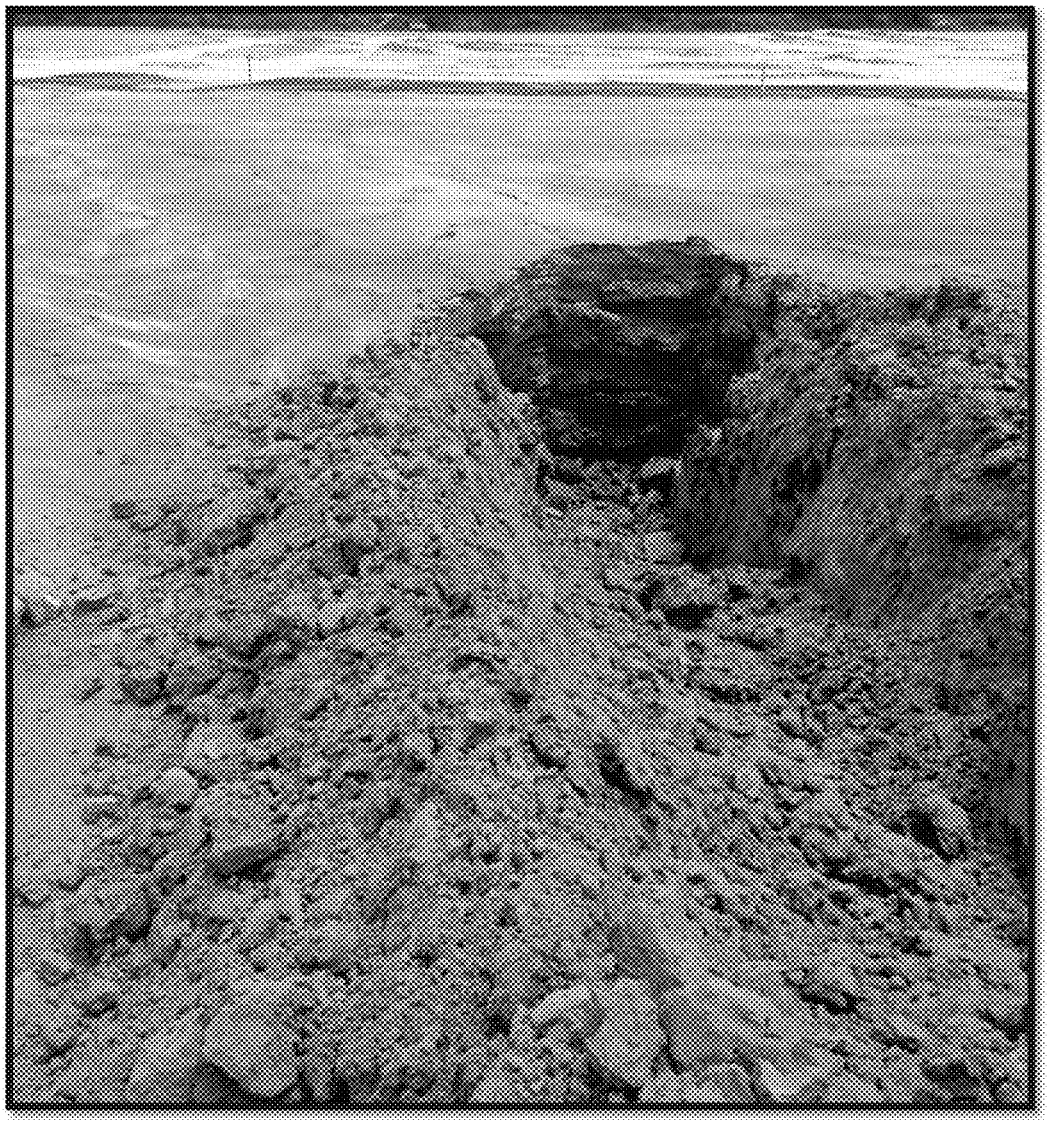
FIG. 5 is a photograph of a hole dug at a point between two different types of horizontal drains in which the CCR is dry all the way to the bottom of the hole, approximately five feet deep, at the drain elevation.
Figure 6:
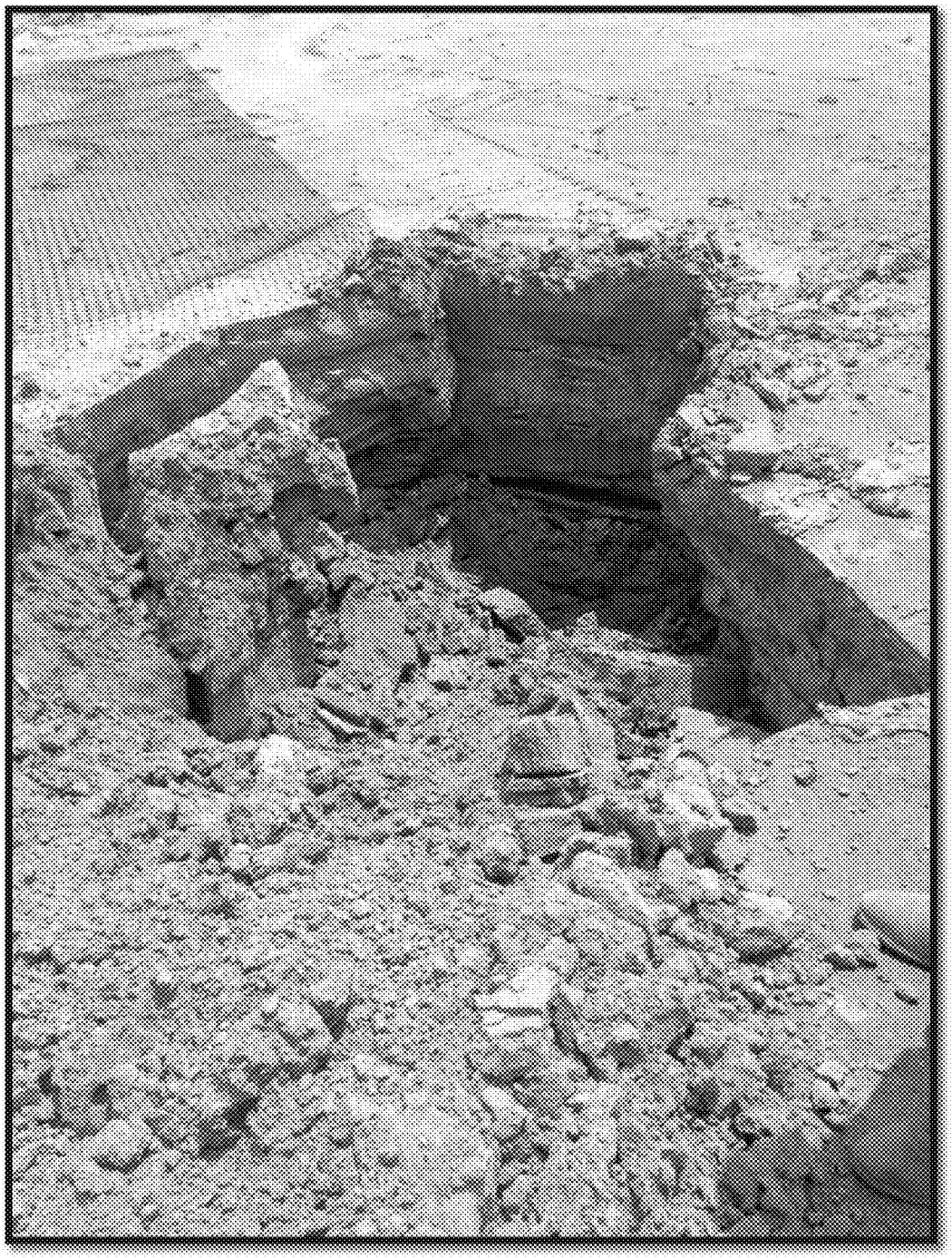
FIG. 6 is a photograph of a hole dug over the top of a horizontal drain in which the CCR is dry all the way to the bottom of the hole, approximately five feet deep, at the drain elevation.

Referring now to FIG. 4 which shows a photo of two holes that were dug by a long reach excavator in areas not over the prefabricated drains, to FIG. 5 which shows a hole dug between the drain test sites, and to FIG. 6 which shows a hole dug over a horizontal test drain. The holes in FIG. 4 which are not over or near the test drains show unstable fly ash and are moister when compared to the photos shown in FIG. 5 which was taken of the hole dug between the drain test sites. The holes shown in FIG. 6 that are over the horizontal drains are very stable and dry down to four to five feet below the surface.

Generally speaking, the figures demonstrate the effect of dewatering using horizontal drains (i.e., with the drains the CCR is dry and without the drains or outside of the area of the drains, the CCR remains wet). More specifically, the holes that were dug by the long reach excavator indicate that the use of horizontal prefabricated drains resulted in drier ash at deeper depths in a CCR pond in a faster more efficient manner than compared to other dewatering methods.

In some instances, CCR material in a CCR pond at a coal-fired power plant with wet flue gas desulfurization operations can be exceptionally difficult to dewater. For example, CCR would be considered difficult to dewater if, over the course of a day, vacuum consolidation dewatering (VCD) has no effect on dewatering the CCR. In such cases, the CCR plugged the prefabricated drain so that the material could not dewater because the water could not migrate through the CCR that was blinding the filtration action of the geotextile envelope surrounding the drain. In other words, the water could not migrate or be vacuumed through the fine CCR material to get to the prefabricated drain to be drawn out of the bench unit.

To solve this problem, the test was restarted, but first, enough CCR material that had previously been successfully dewatered was placed over the prefabricated drain, thereby providing a layer of material approximately two inches thick covering over the prefabricated drain in the bottom of the unit. This caused the easier-to-dewater material to provide a larger surface for the more difficult-to-dewater material to "spread out" and migrate into, rather than plug off the prefabricated drain as was obviously occurring in the sample where VCD was applied directly to the CCR. By locating the separate material (bottom ash, fly ash, sand, or large-diameter-solid particles—in this case bottom ash was used) over the prefabricated drain in this manner, the difficult-to-dewater CCR was successfully dewatered. Specifically, bottom ash was placed over the prefabricated drain to a depth of about two inches covering the drain. The difficult-to-dewater CCR was added to the unit on top of the bottom ash layer and the CCR was successfully dewatered whereas it could not be dewatered previously. This process allows the dewatering of CCR in a very efficient, effective and fast manner compared to other methods known in the art.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of drainage methods and systems available, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims."

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of methods for system and method for dewatering coal combustion residuals known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

We claim:

1. A method for dewatering coal combustion residuals comprising:

installing a plurality of co-planar drains in a coal combustion residual pond underneath at least a portion of the coal combustion residuals;

applying vacuum pressure to the plurality of co-planar drains, thereby drawing water from the coal combustion residuals, through a water permeable material, and through the plurality of co-planar drains.

2. The method of claim 1, wherein each of the plurality of co-planar drains are, at least in part, with a water permeable geotextile materials.

3. The method of claim 1, wherein each of the plurality of co-planar drains are, at least in part, perforated.

4. The method of claim 1, wherein each of the plurality of drains are substantially tubular in shape and are fluidly connected to a single device for applying the vacuum pressure.

5. The method of claim 1, wherein the plurality of co-planar drains underneath at least a portion of the coal combustion residuals are installed by drilling horizontally through the coal combustion residuals in order to install the drains.

6. The method of claim 1, wherein the plurality of co-planar drains underneath at least a portion of the coal combustion residuals are installed by knifing through the coal combustion residuals by trenching or plowing with mechanical equipment in order to install the drains.

7. The method of claim 1, wherein the plurality of co-planar drains underneath at least a portion of the coal combustion residuals are installed by knifing through the solids with water jets in order to install the drains.

8. The method of claim 1, wherein the plurality of co-planar drains underneath at least a portion of the coal combustion residuals are installed at a depth of approximately 1 to 20 ft. below the coal combustion residual's surface.

9. The method of claim 1, wherein in addition to applying vacuum pressure to the plurality of co-planar drains vibrational energy is applied to the coal combustion residual's surface.

10. The method of claim 1, wherein in addition to applying vacuum pressure to the plurality of co-planar drains vibrational energy is applied to the surface of the coal combustion residuals by driving machinery across the surface of the coal combustion residuals to impart vibrations.

11. A method for dewatering coal combustion residuals comprising:

installing a plurality of co-planar drains in a coal combustion residual pond on top of the coal combustion residuals, the drains being covered, at least in part, with a water permeable material;

adding coal combustion residuals on top of the drains;

applying vacuum pressure to the plurality of co-planar drains, thereby drawing water.

12. The method of claim 11, wherein each of the plurality of co-planar drains are covered, at least in part, with a water permeable geotextile material.

13. The method of claim 11, wherein each of the plurality of drains are, at least in part, perforated.

14. The method of claim 11, wherein each of the plurality of drains are substantially tubular in shape and are fluidly connected to a single vacuum pump.

15. The method of claim 11, wherein a 3-inch to 4-foot thick layer of previously dewatered bottom ash, fly ash, sand or large-diameter-solid particles is place over the plurality of co-planar drains to aid in the dewatering of finer coal combustion residuals material.

16. The method of claim 11, wherein in addition to applying vacuum pressure to the plurality of co-planar drains vibrational energy is applied to the coal combustion residual's surface after the coal combustion residuals have been placed on top of the plurality of drains.

* * * * *